United States Patent [19]

Lindeen

[11] 4,344,236

[45] Aug. 17, 1982

[54] WEB DRYING APPARATUS

[75] Inventor: Gale E. Lindeen, Greenville, S.C.

[73] Assignee: The B. F. Goodrich Company, New York, N.Y.

[21] Appl. No.: 217,479

[22] Filed: Dec. 17, 1980

[51] Int. Cl.[3] ..... F26B 13/08

[52] U.S. Cl. ..... 34/110; 34/119; 34/124; 165/89

[58] Field of Search ..... 34/108, 110, 119, 124; 29/110, 118, 119; 100/93 RP; 162/375, 378, 379, 207; 165/89, 146, 185; 219/10.49 A, 469; 432/10, 60, 253, 255.1; 220/322

[56] References Cited

U.S. PATENT DOCUMENTS

| | | | |
|---|---|---|---|
| 1,640,855 | 8/1927 | Shlick | 34/110 |
| 2,074,455 | 3/1937 | Carleton | 34/110 |
| 2,591,307 | 4/1952 | Sibel | 34/110 |
| 4,192,080 | 3/1980 | Irpola | 34/110 |
| 4,241,518 | 12/1980 | Alexy | 34/110 |

*Primary Examiner*—Larry I. Schwartz

*Attorney, Agent, or Firm*—Joseph Januszkiewicz

[57] ABSTRACT

A drying apparatus for drying a moving web of textile fabric material as it passes over a series of closely adjacent rotating cylinders. Each cylinder has a pair of end portions and an intermediate portion. A heat insulating cap is mounted on each end portion to restrict the flow of heat energy therefrom.

1 Claim, 3 Drawing Figures

FIG. 1
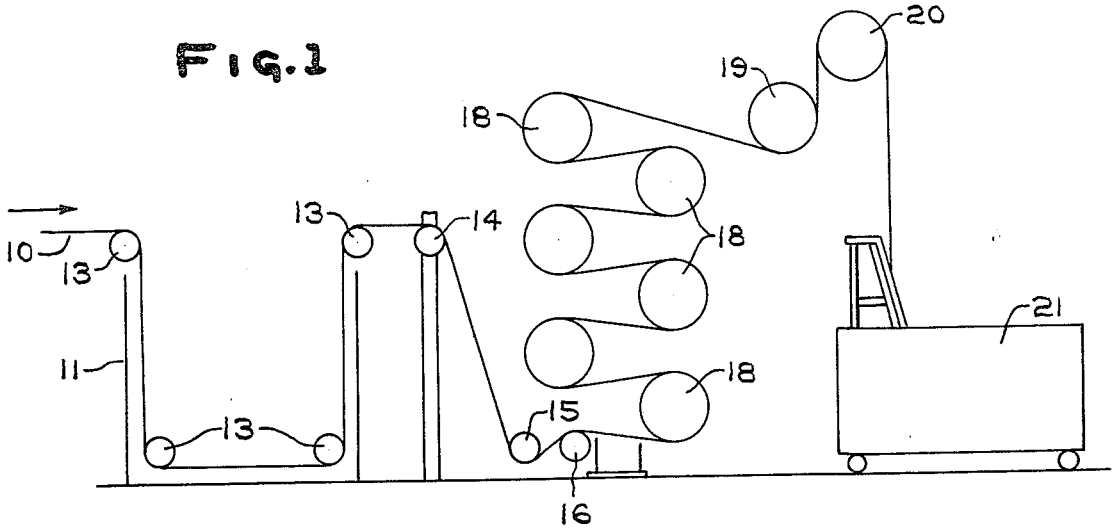
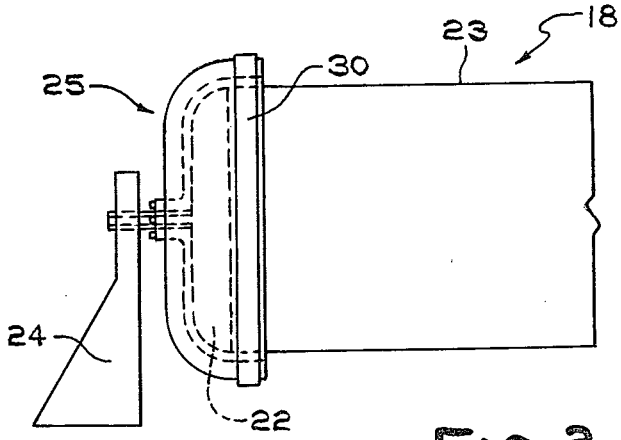
FIG. 2
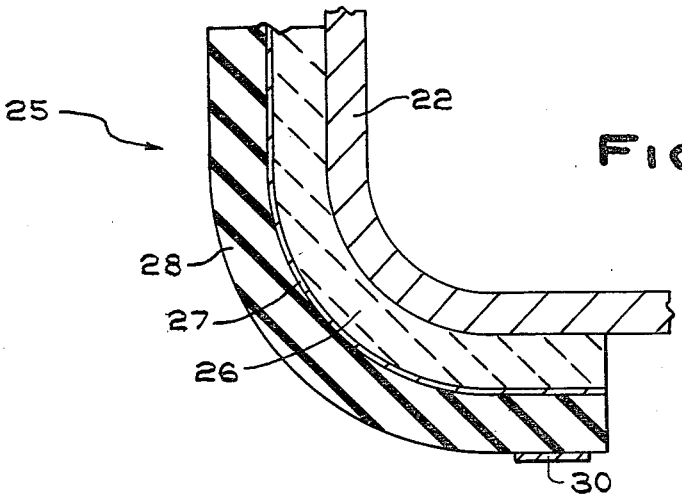
FIG. 3

WEB DRYING APPARATUS

BACKGROUND OF THE INVENTION

This invention relates to an apparatus for drying webs and more particularly to a new and improved means for drying textile webs.

Web as used throughout the specification and claims is intended to include artificial as well as synthetic materials. Artificial materials includes all types of sheet materials such as textile fabric, paper, films formed from regenerated cellulose whereas synthetic materials includes all types of synthesized materials.

In the processing of web materials such as textiles, cloth, and the like it is accepted practice for commercial operations to dry such webs by passing it around a series of drums or cylinders that are internally heated. Such drums are arranged in overlapping relationships so that the film or web comes in contact with one side of a major portion of the heated cylinder and then passes to a second drum or cylinder. The cylinders are all rotated at the same peripheral speed. In addition to heating the drums, air may be blown past the drums to facilitate the drying of the web material. A sufficient number of cylinders are used in the drying of the web to achieve a proper drying.

The present invention contemplates a more effecient means for drying the cloth by reducing the amount of energy necessary to dry the moving web, which can result in reducing the number of drying cylinders and the cost of manufacturing cloth. A further benefit of this invention is that the heat or drying energy is used for the purpose of drying the web and not for dissipation in the adjacent environment. With the use of a rubber insulating cap of one-half inch thickness on a single cylinder, a savings of 8,556 BTU/hr. is achieved. Operating at a steam pressure of 76 PSIG, approximately 9.56 pounds of steam per hour were saved per cylinder. The total savings is considerable taking into account the number of cylinders used in drying the textile web. In addition, there is a greater degree of freedom from pollution.

SUMMARY OF THE INVENTION

The present invention contemplates the insulating of the respective ends of each drying cylinder in a bank of rotating drying cylinders thereby restricting the radiant flow of heat energy through the metal cylinder ends. This restricted flow of heat energy results in less initial steam energy input to the drying cylinders for the same drying results which in effect provides more radiant heat energy for emission through the cylinder's circumferencial area for drying.

BRIEF DESCRIPTION OF THE DRAWINGS

FIG. 1 is a schemmatic side elevational view of a portion of a textile processing line showing textile drying cylinders.

FIG. 2 is an enlarged front elevational view of an end portion of a drying cylinder.

FIG. 3 is a fragmentary cross-sectional view of an end portion of a drying cylinder and insulating means.

DETAILED DESCRIPTION

Referring now to the drawings, wherein like reference numerals designate like or corresponding parts throughout the several views, there is shown in FIG. 1 a portion of a web processing procedure such as for textile or mercerizing process. In such process a roll of textile fabric or web 10 is unwound and processed in a series of caustic soda bath, stretched, and then washed as in tank 10 by passing such fabric 10 over a series of rolls 13 that maintain a uniform tension on the web. The web 10 is then guided over a series of rollers 14, 15 and 16 and then passed to a bank of drying cylinders 18 to be described. The web or textile fabric is then guided over a series of guide rolls 19 and 20 for folding into a portable scrap 21.

The invention refers to one bank or tier of drying cylinders, however, more than one bank of cylinders may be used. The number in each tier or bank may be increased or decreased to achieve the necessary drying function of the web. The drying cylinders 18 are rotatably mounted in suitable bearings and positively driven at the same peripheral speed as by suitable gears, belts, chains and sprocket mechanisms. Each cylinder or roll 18 is heated internally by any suitable means such as steam in a manner old and well known in the art. A hood (not shown) may be positioned above the tier or bank of cylinders to facilitate the removal of the moisture laden air. The heated cylinders drive the moisture through the web and the air picks up the moisture and directs it up through the hood and the exhaust system.

Drying cylinder 18 has a pair of end portions 22 (only one shown) and an intermediate cylindrical portion 23 made of steel or some suitable member made of metal that conducts heat since a continuous web of cloth is wrapped approximately 300° around the circumference of the cylinder. The cylinder is shown as supported by a bracket 24 on one end and is supported on the other end by a similar bracket but having a universal fitting at the axis thereof to permit the introduction of steam therein and the exhaust of the corresponding medium.

Insulating end caps 25 are provided for the respective end portions 22 of the drying cylinders to restrict the flow of heat therethrough. Such insulating end caps may be rubber caps only or a combination of other insulating materials. FIG. 3 discloses a dish shaped layer of fiberglass 26 positioned on the respective of the cylinders. A layer of foil 27 is then positioned over the respective layers of fiberglass followed by a dish shaped layer of rubber 28. Such described insulating end caps 25 may be secured on the respective ends of the cylinders by a suitable strapping band 30 that is applied closely adjacent to the outside periphery of the cap. The caps 25 have suitable central apertures to facilitate the installation of the caps over the centrally disposed bearing portions or where a universal fitting is connected to the center of the end cap to provide for the introduction of steam for heating the cylinders.

A modification of the end caps is to have the end cap made entirely of rubber to simplify the structure thereof. Such insulating end caps may also be connected to the respective ends of the cylinders by metal studs or rivets. Prior to the placing of the rubber cap or caps 25 onto the end of the cylinders, a plurality of holes are drilled therethrough. Studs are then welded to the respective ends of the cap corresponding to the locations on the insulating caps. The caps are then placed over the ends of the cylinder and the caps are secured to the cylinder with the aid of studs. A band 30 is then secured around the cap as described above to insure a firm connection with the cap and the cylinder since the cylinder will be rotating.

I claim:

1. A drying apparatus for drying a traveling web comprising a hollow cylinder, said cylinder having a pair of end portions and an intermediate cylindrical portion, means connected to said cylinder for rotating said cylinder about its central axis, heating means connected to said cylinder for heating the interior of said cylinder, heat insulating end caps mounted on the respective end portions of said cylinder for restricting the flow of heat energy from said end portions, each of said end caps are made from an inner layer of insulating material and an outer layer of rubber with a layer of foil interposed between said inner layer and said outer layer of rubber, and a circumferentially extending strap around the periphery of said cylinder to secure said cap to said cylinder.

* * * * *